US007934278B2

(12) United States Patent
Oh et al.

(10) Patent No.: US 7,934,278 B2
(45) Date of Patent: May 3, 2011

(54) WASHING METHOD OF WASHING MACHINE AND APPARATUS THEREOF

(75) Inventors: Soo-Young Oh, Seoul (KR); Kyung-Chul Woo, Seoul (KR); Jin-Woong Kim, Gwangmyeong (KR); Si-Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 1001 days.

(21) Appl. No.: 10/751,978

(22) Filed: Jan. 7, 2004

(65) Prior Publication Data

US 2005/0034249 A1 Feb. 17, 2005

(30) Foreign Application Priority Data

Aug. 13, 2003 (KR) ..... 10-2003-0056268

(51) Int. Cl.
*D06B 19/00* (2006.01)
*D06B 1/02* (2006.01)

(52) U.S. Cl. ..... 8/149.3; 8/149.1; 8/149.2; 68/5 R; 68/5 C

(58) Field of Classification Search ..... 8/149.1, 8/149.2, 149.3; 68/5 R, 5 C
See application file for complete search history.

(56) References Cited

U.S. PATENT DOCUMENTS

| | | | | |
|---|---|---|---|---|
| 1,852,179 | A * | 4/1932 | McDonald | 68/183 |
| 1,946,278 | A * | 2/1934 | Elfving | 68/192 |
| 4,527,343 | A * | 7/1985 | Danneberg | 34/452 |
| 4,941,333 | A * | 7/1990 | Blessing | 68/19.2 |
| 5,390,385 | A * | 2/1995 | Beldham | 8/158 |
| 6,023,950 | A * | 2/2000 | Battistella | 68/12.04 |
| 6,585,781 | B1 * | 7/2003 | Roseen | 8/149.1 |
| 6,612,138 | B2 | 9/2003 | Ryu et al. | |
| 6,615,619 | B2 | 9/2003 | Kakuda et al. | |
| 2004/0187527 | A1 | 9/2004 | Kim et al. | |

FOREIGN PATENT DOCUMENTS

| | | | |
|---|---|---|---|
| DE | 197 43 508 | A1 | 4/1999 |
| EP | 0 816 550 | A1 | 1/1998 |
| EP | 1275767 | A1 * | 1/2003 |
| GB | 799788 | A | 8/1958 |
| JP | 2002-011279 | A | 1/2002 |
| JP | 2003-19382 | A | 1/2003 |
| JP | 2003-93775 | A | 4/2003 |

* cited by examiner

*Primary Examiner* — Alexander Markoff
(74) *Attorney, Agent, or Firm* — McKenna Long & Aldridge LLP

(57) ABSTRACT

Disclosed are a washing method of a washing machine capable of preventing a phenomenon that remaining detergent is collected into a space where a heater is positioned or a specific space during a washing operation of laundry, capable of minimizing a generation of washing water unnecessarily supplied to the washing machine, and capable of fast heating corresponding laundry before a washing operation for an efficient washing operation, and an apparatus thereof. To this end, the method comprises the steps of: generating steam by heating washing water supplied into a washing machine; injecting the generated steam into laundry inside of a drum of the washing machine; and rotating the drum after injecting the steam into the laundry and thereby washing the laundry.

9 Claims, 5 Drawing Sheets

WASHING METHOD OF WASHING MACHINE AND APPARATUS THEREOF

This Nonprovisional application claims priority under 35 U.S.C. §119(a) on Patent Application No(s). 10-2003-56268 filed in KOREA on Aug. 13, 2003, the entire contents of which are hereby incorporated by reference.

BACKGROUND OF THE INVENTION

1. Field of the Invention

The present invention relates to a washing machine, and more particularly, to a washing method of a drum type washing machine and an apparatus thereof.

2. Description of the Conventional Art

Generally, a washing machine is an apparatus for washing laundry by washing, rinsing, and dehydrating. The washing machine is divided into a pulsator type, an agitation type, a drum type, and etc. by a washing method. Hereinafter, a general drum type washing machine will be explained with reference to FIG. 1.

FIG. 1 is a schematic sectional view of a general drum type washing machine.

As shown, the drum type washing machine 1 comprises: a drum 4 having a plurality of lifts 5 therein for washing laundry; a rotating axis 3 coupled to the drum 4 for rotating the drum 4; a motor 6 for transmitting a rotation force to the rotating axis 3 through a pulley; a tub 2 coupled to an outer side of the drum 4 for supporting the rotating axis 3 and storing washing water; and a heater 7 installed at a lower portion of the tub 2 for heating washing water. Hereinafter, operation of the general drum type washing machine will be explained.

First, when a user puts laundry into the drum 4 of the drum type washing machine 1 and then presses a starting button, washing water is supplied to the drum 4 and at the same time a power source is applied to the motor 6. At this time, a rotation force of the motor 6 reaches up to the rotating axis 3 by a driving system by a pulley and a belt, and the rotating axis 3, and the rotating axis 3 is rotated by a rotation force of the motor 6. That is, since the drum 4 repeats a forward rotation and a reverse rotation by the rotating axis 3, laundry inside of the drum 4 is washed. Also, a washing operation is performed by an impact power and an extension/contraction generated accordingly as laundry is lifted by the plurality of lifts 5 formed at an inner surface of the drum 4 and is dropped.

In the drum type washing method, a washing operation is performed by using a frictional force between the drum 4 which rotates by a rotation force of the motor 6 and laundry under a state that detergent, washing water, and laundry are put into the drum. According to the drum type washing method, laundry is scarcely damaged, laundry is not tangled, and a washing effect such as beating and rubbing can be obtained.

Meanwhile, details for the conventional drum type washing machine are also disclosed in the U.S.A patents of U.S. Pat. Nos. 6,615,619 and 6,612,138.

However, in the conventional drum type washing machine, since the heater 7 for heating washing water is positioned at a lower portion of the tub 2, remaining detergent is collected into a space where the heater 7 is positioned while washing laundry.

Also, in the conventional drum type washing machine, since the heater 7 for heating washing water is positioned at the lower portion of the tub 2, washing water supplied to the drum type washing machine is increased when water is supplied to a space necessary to install the heater 7. Since the heater 7 is installed at the lower portion of the tub 2, an interval between the drum 4 and the tub 2 becomes wide and thereby washing water supplied to the interval between the drum 4 and the tub 2 is increased.

Also, in the conventional drum type washing machine, laundry is slowly soaked by washing water due to tumbling of the washing water.

SUMMARY OF THE INVENTION

Therefore, an object of the present invention is to provide a washing method of a washing machine capable of preventing a phenomenon that remaining detergent is collected into a space where a heater is positioned or a specific space during a washing operation of laundry, and an apparatus thereof.

Another object of the present invention is to provide a washing method of a washing machine capable of minimizing a generation of washing water unnecessarily supplied to the washing machine, and an apparatus thereof.

Still another object of the present invention is to provide a washing method of a washing machine capable of fast heating corresponding laundry before a washing operation for an efficient washing operation, and an apparatus thereof.

To achieve these and other advantages and in accordance with the purpose of the present invention, as embodied and broadly described herein, there is provided a washing method of a washing machine comprising the steps of: generating steam by heating washing water supplied into a washing machine; injecting the generated steam into laundry inside of a drum of the washing machine; and rotating the drum and thereby washing the laundry.

To achieve these and other advantages and in accordance with the purpose of the present invention, as embodied and broadly described herein, there is also provided a washing apparatus of a washing machine comprising: a steam generating means for generating steam by heating washing water supplied into a washing machine; an injecting means for injecting the generated steam into laundry inside of a drum of the washing machine; and a washing means for rotating the drum of the washing machine and thereby washing the laundry.

A washing apparatus of a washing machine according to the present invention comprises: a drum rotated by a rotation force of an inner motor of a drum type washing machine for washing laundry; a water supply pipe for supplying washing water into the drum; a detergent box for supplying detergent into the drum; a steam generating unit for supplying steam into the drum; an injection nozzle for injecting the steam generated from the steam generating unit into the drum; a drain pipe for draining washing water inside of the drum; and a circulation pump for pumping washing water drained from the drain pipe and thus circulating into the injection nozzle through a cyclic water pipe.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a washing method of a washing machine capable of preventing a phenomenon that remaining detergent is collected into a space where a heater is positioned or a specific space during a washing operation, capable of minimizing a generation of washing water unnecessarily supplied to the washing machine, and capable of fast heating corresponding laundry before a washing operation for an efficient washing operation by generating steam by heating washing water supplied into a washing machine, injecting the generated steam into laundry inside of a drum of the washing machine, and rotating the drum and thereby washing the laundry, and an apparatus thereof will be explained with reference to FIGS. 2 to 6.

Figure 1:
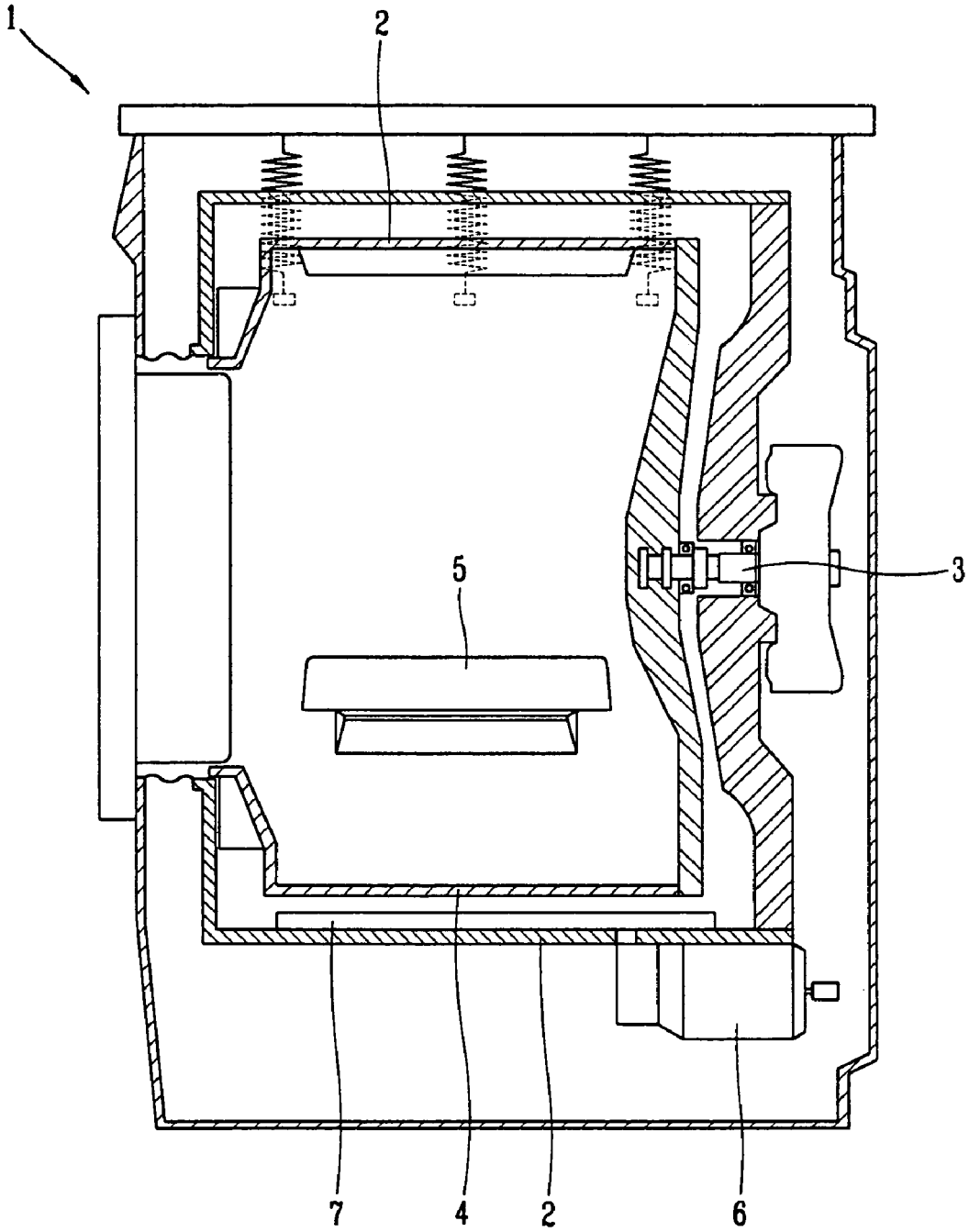
FIG. 1 BACKGROUND ART
FIG. 1 is a schematic sectional view of a general drum type washing machine.
Figure 2:
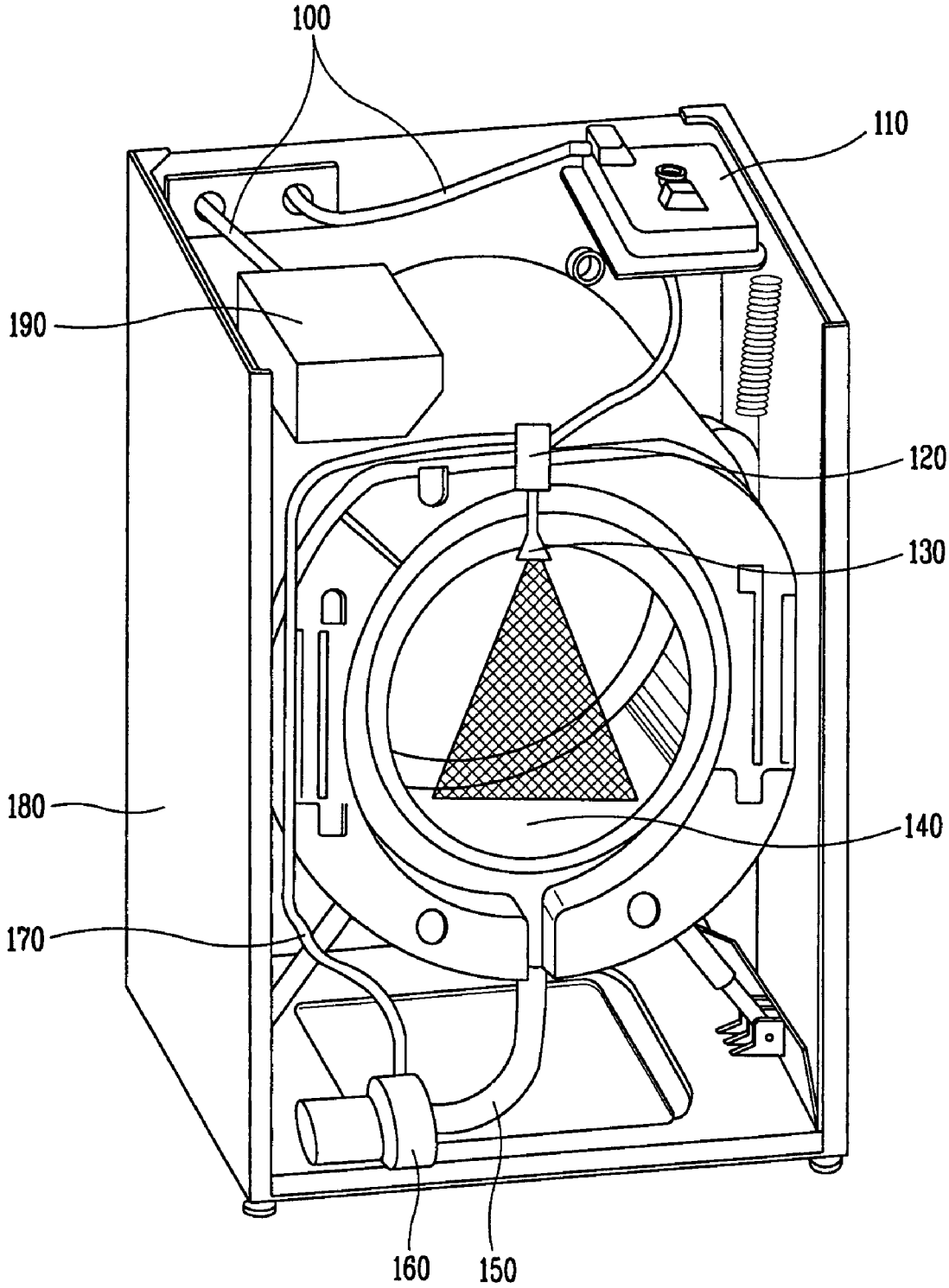
FIG. 2 is a schematic perspective view of a drum type washing machine where a steam generating unit is mounted according to the present invention.

FIG. 2 is a schematic perspective view of a drum type washing machine where a steam generating unit is mounted according to the present invention.

As shown, the drum type washing machine where a steam generating unit is mounted according to the present invention comprises: a drum 140 rotated by a rotation force of an inner motor (not shown) of a drum type washing machine for washing laundry; a water supply pipe 100 for supplying washing water into the drum 140; a detergent box 190 for supplying detergent into the drum 140; a steam generating unit 110 for supplying steam into the drum 140; an injection nozzle 130 for injecting the steam generated from the steam generating unit 110 into the drum 140 through a reverse flow preventing basin device 120; a drain pipe 150 for draining washing water inside of the drum 140; and a circulation pump 160 for pumping washing water drained from the drain pipe 150 and thus circulating into the reverse flow preventing basin device 120 through a cyclic water pipe 170; and an outer cabinet 180 for protecting the drum 140, the drain pipe 100, the detergent box 190, the steam generating unit 110, the injection nozzle 130, the drain pipe 150, and the circulation pump 160.

Hereinafter, the steam generating unit 110 according to the present invention will be explained with reference to FIG. 3.

Figure 3:
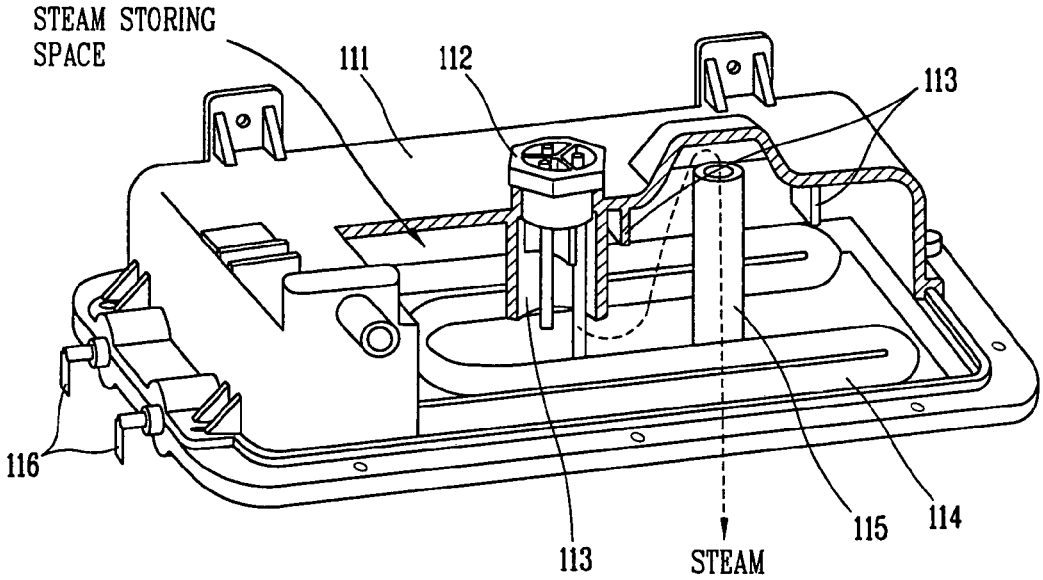
FIG. 3 is a view showing a construction of a stream generating unit installed in a drum type washing machine according to the present invention.

FIG. 3 is a view showing a construction of a stream generating unit installed in a drum type washing machine according to the present invention.

As shown, the steam generating unit 110 comprises: a container 111 for storing steam; a heater 114 installed in the container 111 for heating supplied water and thereby converting into steam when water is supplied into the container 111 up to a predetermined water level; a heater connector 116 for supplying a power source to the heater 114; a steam exhaustion pipe 115 for exhausting steam into the drum 140 of the washing machine through the injection nozzle 130 when the steam stored in the container 111 reaches or exceeds a certain pressure; a water level sensor 112 positioned at a center portion of the steam generating unit 110 for controlling a water level inside of the container 111; and a diaphragm 113 installed in the container 111 for preventing a disturbance phenomenon of water inside of the container 111 when the washing machine is vibrated. The diaphragm 113 is installed in the container 111 with plural numbers in order to make the water level sensor 112 control a water level when the washing machine is vibrated. Herein, the water level sensor 112 and the diaphragm 113 can be installed by a need.

Hereinafter, operation of the drum type washing machine according to the present invention will be explained.

First, when a user presses a washing operation button (not shown) installed in the washing machine, a water supply valve (not shown) of the washing machine is opened thus to supply washing water with detergent inside of the detergent box 190 up to a predetermined water level.

When the water supply is finished, the water supply valve is closed, the circulation pump 160 is operated, and a water circulation for dissolving the detergent is performed for a predetermined time.

Subsequently, once water supply for generating steam is supplied into the steam generating unit 110 up to a predetermined water level, the supplied water is heated by the heater 114 installed in the steam generating unit 110 thus to be converted into steam. The converted steam is collected into a steam storing space of the steam generating unit 110, and when the steam reaches or exceeds a certain pressure, the steam is injected into the drum 140 of the washing machine through the injection nozzle 130.

Hereinafter, the washing method of the drum type washing machine according to the present invention will be explained with reference to FIG. 4.

Figure 4:
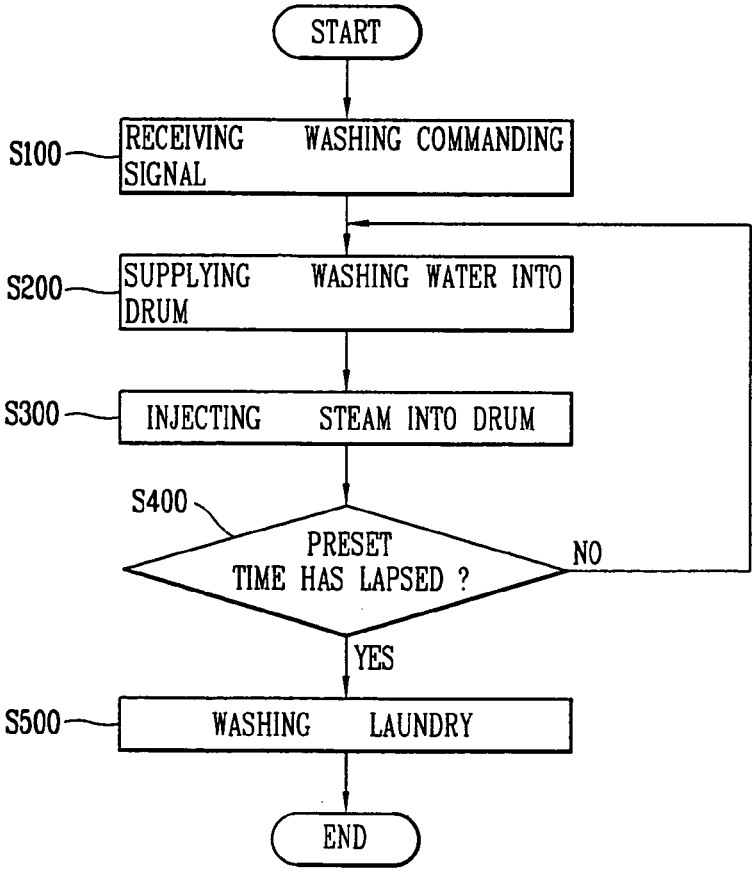
FIG. 4 is a view showing a washing method of a drum type washing machine according to the present invention.

FIG. 4 is a view showing a washing method of a drum type washing machine according to the present invention.

First, when a washing commanding signal is received by a user's key adjustment (S100), a controlling unit (not shown) supplies washing water into the drum where laundry is put. That is, the controlling unit supplies washing water into a washing water receiving region between the drum 140 and a tub (not shown), and supplies the supplied washing water into the drum when the washing water reaches to a preset upper limit water level. Also, when a water level of the washing wash receiving region reaches a preset lowest limit accordingly as the laundry absorbs washing water and thereby a water level of the washing water receiving region is lowered, the controlling unit re-supplies the washing water into the drum with a repetition for a preset time thus to soak laundry inside of the drum by washing water (S200).

Subsequently, when the preset time lapses and thereby said step (S200) is finished, the controlling unit generates an operational signal and outputs the generated operational signal to the steam generating unit 110.

The steam generating unit 110 generates steam by heating the washing water on the basis of the operational signal, and injects the generated steam into the drum 140 through the injection nozzle 130. That is, steam is generated by using the steam generating unit 110 connected to the drum 140, and the generated steam is injected into laundry inside of the drum (S300).

Next, when an inner temperature of the steam generating unit becomes a preset temperature, the controlling unit stops an operation of the steam generating unit 110 thus to finish said step (S300) and then sequentially performs said steps (S200, S300) repeatedly for a preset time (S400). As the generated steam is supplied into laundry inside of the drum, a washing efficiency can be increased with a small quantity of washing water. For example, washing water supplied through the water supply pipe 100 is converted into steam and the converted steam is supplied into the drum without installing a heater at a lower portion of the tub of the drum type washing machine. According to this, an interval between the drum and the tub need not be widened in order to install the heater at the lower portion of the tub, and as the interval between the drum and the tub becomes narrow, a quantity of washing water supplied between the drum and the tub 2 is decreased. Therefore, a phenomenon that remaining detergent is collected into a space where the heater is positioned or a specific space during a washing operation is prevented, and a generation of washing water unnecessarily supplied into the washing machine can be minimized.

Then, when a preset time for supplying the washing water and steam into the drum 140 lapses, the controlling unit drives the motor so that the drum 140 can repeat a forward rotation and a reverse rotation thus to wash laundry inside of the drum (S500) and finishes the entire washing operation.

Meanwhile, said step for supplying the washing water into the drum (S200) can be performed by various embodiments. Accordingly, hereinafter, preferred embodiments for supplying the washing water into the drum efficiently will be explained with reference to FIG. 5.

Figure 5:
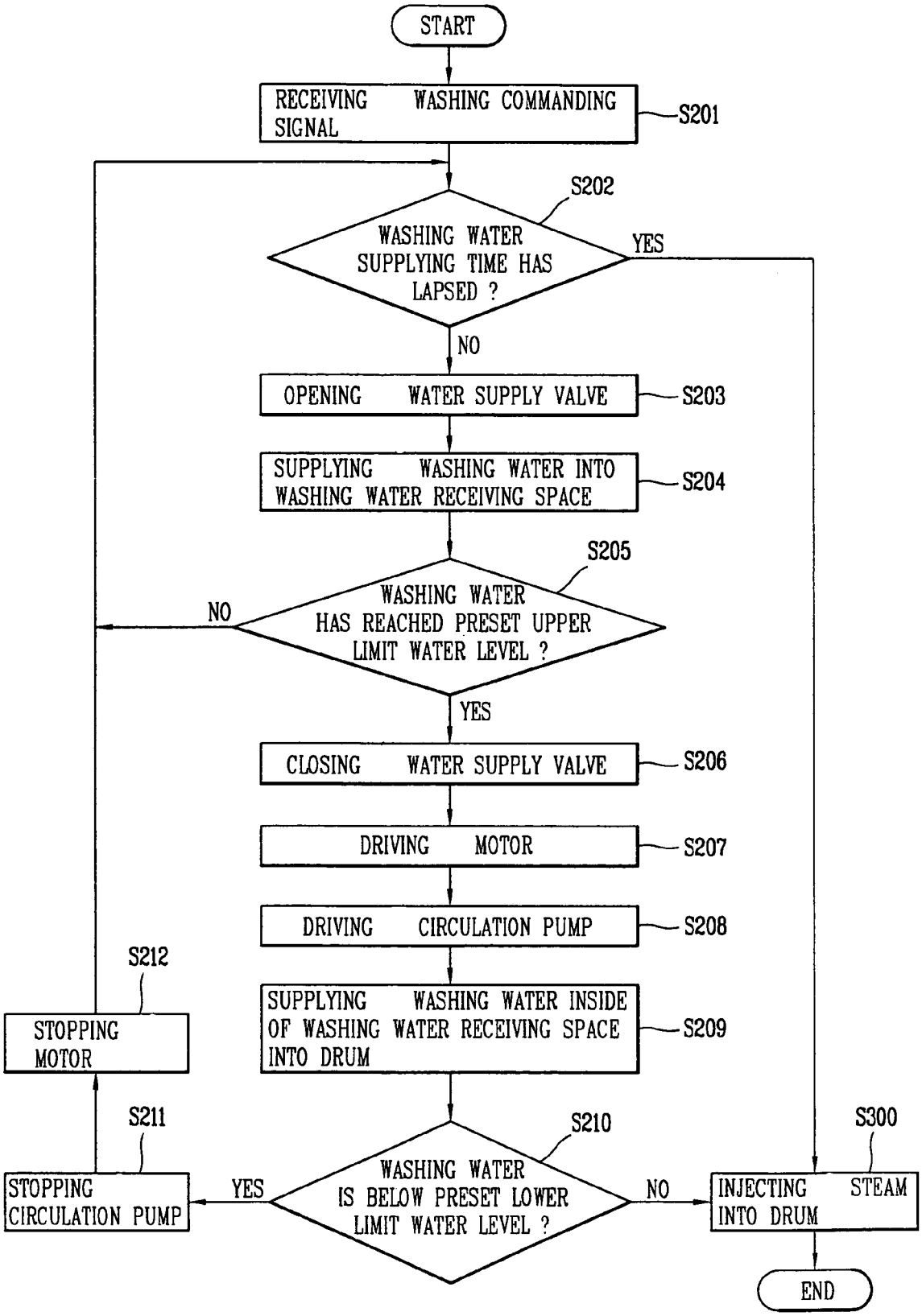
FIG. 5 is a view showing preferred embodiments of a method for supplying washing water into a drum in a washing method of a drum type washing machine according to the present invention.

FIG. 5 is a view showing preferred embodiments of a method for supplying washing water into a drum in a washing method of a drum type washing machine according to the present invention.

First, when the washing commanding signal is received (S201), the controlling unit judges whether a washing water supplying time lapses according to the washing commanding signal (S202). When the washing water supplying time has not lapsed, the controlling unit opens the water supply valve (S203) thus to supply washing water into a space between the drum and the tub (the washing water receiving space) (S204).

Then, the controlling unit detects a water level inside of the washing water receiving space through a water level detecting unit (not shown) thus to judge whether a water level inside of the washing water receiving space has reached a preset upper limit (S205). When the water level inside of the washing water receiving space has not reached the preset upper limit, the controlling unit supplies the washing water into the washing water receiving space for the washing water supplying time. On the contrary, when the water level inside of the washing water receiving space has reached the preset upper limit, the controlling unit closes the water supply valve (S206) and then drives the inner motor and the circulation pump inside of the drum type washing machine (S207, S208).

The circulation pump 160 performs a circulation pumping operation on the basis of a control signal of the controlling unit, and circulates washing water supplied into the washing water receiving space into the drum where laundry is put (S209). At this time, the washing water is absorbed into the laundry inside of the drum, so that the laundry is soaked.

Then, the controlling unit detects a water level inside of the washing water receiving space which becomes lower accordingly as washing water is supplied into the drum through the water level detecting unit, and judges whether a water level inside of the washing water receiving space has reached a preset lowest limit (S210). When the water level inside of the washing water receiving space has reached the preset lowest limit, the controlling unit stops a driving of the motor (S211) and stops a driving of the circulation pump thus to finish a step for circulating washing water supplied into the washing water receiving space into the drum (S212).

Next, when said step (S212) is finished, the controlling unit re-supplies the washing water into the washing water receiving space until the washing water reaches the preset upper water level.

When the water level inside of the washing water receiving space is not lowered thus to maintain the preset upper limit water level for a preset washing water supplying time or the washing water supplying time has lapsed, the controlling unit stops a supply of the washing water and returns to the step for injecting the steam into the drum (S300).

The step for injecting the steam into the drum (S300) can be performed by various embodiments. Accordingly, hereinafter, preferred embodiments for effectively injecting the steam into the drum will be explained with reference to FIG. 6.

Figure 6:
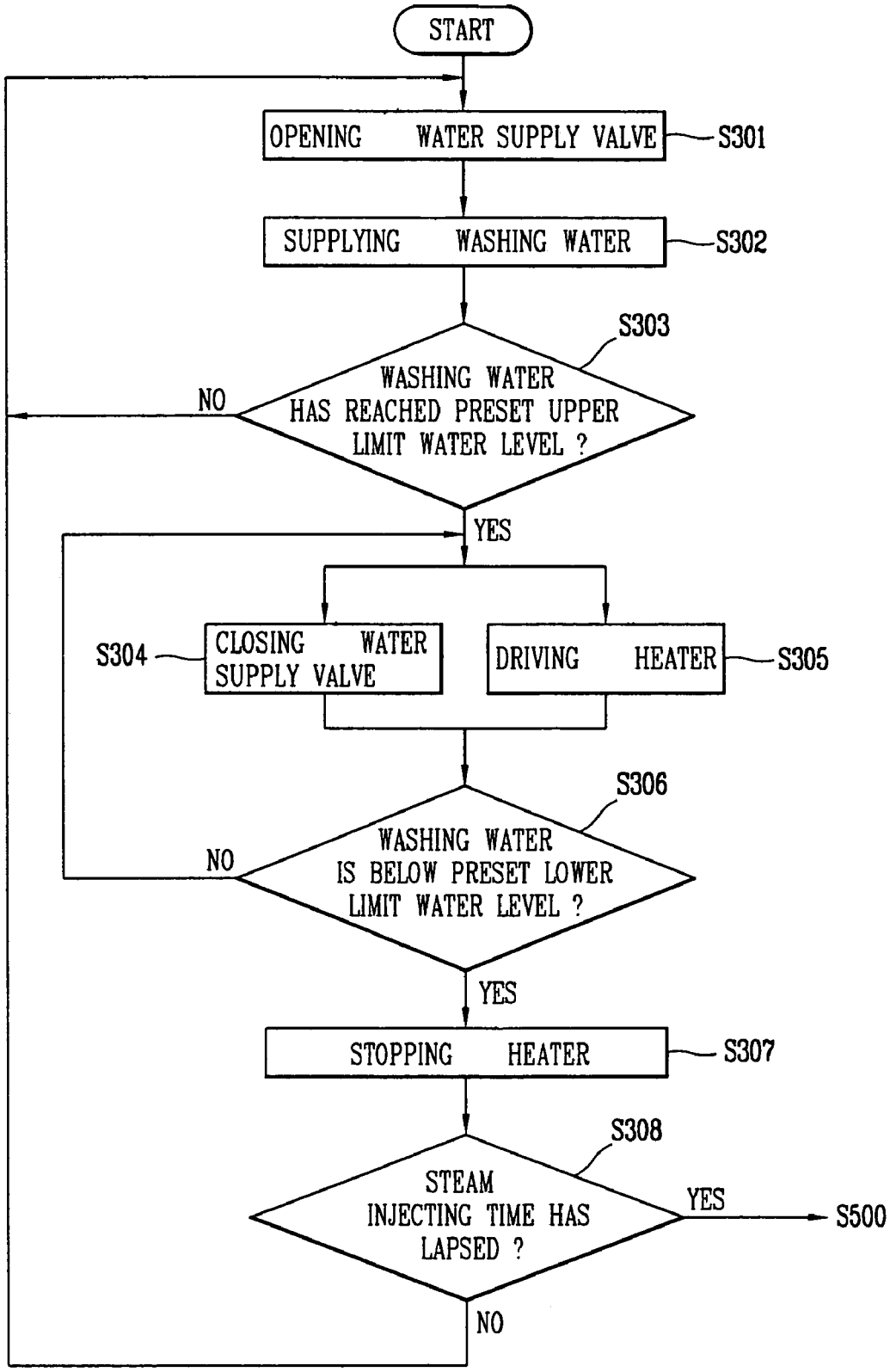
FIG. 6 is a view showing preferred embodiments of a method for injecting steam into a drum in a washing method of a drum type washing machine according to the present invention.

FIG. 6 is a view showing preferred embodiments of a method for injecting steam into a drum in a washing method of a drum type washing machine according to the present invention.

First, when the step for supplying the washing water into the drum is finished, the controlling unit opens the water supply valve (S301). When the water supply valve is opened, water supplied through the water supply pipe 100 connected to the water supply valve is supplied into the steam generating unit 110 (S302). Herein, the steam generating unit 110 is connected to the drum 140 for receiving laundry through a pipe.

When water is supplied into the steam generating unit, the water level sensor 112 judges whether a level of water supplied into the steam generating unit has reached a preset upper limit water level inside of the steam generating unit (S303).

When the rising water level has reached the preset upper limit water level, the water level sensor 112 outputs a water supply valve closing signal to the controlling unit. At this time, the controlling unit closes the water supply valve on the basis o the water supply valve closing signal (S304), and drives the heater 114 inside of the steam generating unit (S305).

The steam generating unit 110 heats the supplied water for a preset time on the basis of a control signal of the controlling unit thus to generate steam, and supplies the generated steam into the reverse flow preventing basin device 120 through the exhaustion pipe 115.

The reverse flow preventing basin device 120 injects the supplied steam into laundry inside of the drum through the injection nozzle 130.

Then, when a water level inside of the steam generating unit 110 has reached a preset lowest water level inside of the steam generating unit (S306), the water level sensor 112 generates a stopping signal. At this time, the steam generating unit 110 stops an operation of the heater 114 on the basis of the stopping signal (S307), and the controlling unit judges whether a preset steam injecting time has lapsed (S308).

When the preset steam injecting time has lapsed, the controlling unit finishes the step for injecting steam (S300) and returns to the step for washing the laundry (S500). That is, the motor is rotated by a control signal of the controlling unit, and the drum 140 which has received a rotation force of the motor is rotated, thereby washing the laundry. On the contrary, when the preset steam injecting time has not lapsed or a level of water supplied into the steam generating unit 110 has not reached the preset upper limit water level in said judging step (S303), the controlling unit returns to the step for opening the water supply valve (S301).

Meanwhile, the washing method of the present invention can be applied to a pulsator washing machine, an agitation washing machine, and a drum type washing machine.

As aforementioned, in the washing method of a washing machine and the apparatus thereof according to the present invention, steam is generated by heating washing water supplied into the washing machine and the generated steam is injected into laundry inside of the drum of the washing machine. Then, the drum is rotated thus to wash the laundry, thereby preventing a phenomenon that remaining detergent is collected into a space where the heater is positioned or a specific space during a washing operation of laundry.

Also, in the washing method of a washing machine and the apparatus thereof according to the present invention, washing water supplied into the washing machine is heated thus to generate steam, and the generated steam is injected into laundry inside of the drum of the washing machine. Then, the drum is rotated thus to wash the laundry, thereby minimizing a generation of washing water unnecessarily supplied to the washing machine.

Also, in the washing method of a washing machine and the apparatus thereof according to the present invention, washing water supplied into the washing machine is heated thus to generate steam, and the generated steam is injected into laundry inside of the drum of the washing machine. Then, the drum is rotated thus to wash the laundry, thereby fast heating corresponding laundry before a washing operation for an efficient washing operation.

Also, in the steam generating unit applied to the washing apparatus of the washing machine according to the present invention, water is refilled in a small container through the water level sensor thus to generate steam, thereby implementing a size of the container compactly than a required steam generation amount.

Besides, the steam generating unit applied to the washing apparatus of the washing machine according to the present invention is implemented compactly thus to be easily installed in the washing machine.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method of washing laundry for a drum-type washing machine including a tub, a drum located inside the tub, and the drum including a plurality of lifts formed on an inner surface of the drum, the method comprising:

opening a water supply valve to supply water into the drum, the water being received in a washing water receiving space that includes a space between the drum and the tub;

closing the water supply valve to stop supplying water into the drum;

rotating the drum to soak the laundry located in the drum with the supplied water in the washing water receiving space, wherein the laundry is tumbled by being lifted and dropped by the plurality of lifts as the drum is rotated;

repeating the opening of the water supply valve; the closing of the water supply valve; and the rotating of the drum until a certain amount of water is maintained at the washing water receiving space indicating that the laundry is soaked;

while maintaining the water supply valve closed after the certain amount of water is maintained until the start of a water washing cycle, injecting steam into the drum to heat the laundry using a steam generator located between an outer cabinet and the drum, wherein the water supplied to the steam generator is independent from the water in the washing water receiving space; and after injecting the steam, starting the washing cycle to wash the laundry with the laundry being lifted and dropped by the plurality of lifts as the drum is rotated.

2. The method of claim 1, wherein rotating the drum to soak laundry with the supplied water comprises circulating the water received in the washing water receiving space into the drum.

3. The method of claim 1, further comprising:

detecting a level of the water received in the washing water receiving space; and if the detected level of the water reaches a preset upper limitation level, driving a circulation pump thereby circulating the water received in the washing water receiving space into the drum.

4. The method of claim 1, wherein rotating the drum to soak laundry with the supplied water comprises circulating the water received in the washing water receiving space into the drum for a preset time.

5. The method of claim 1, further comprising:

detecting a level of the water received in the washing water receiving space; and if the detected level of the water reaches a preset lower limitation level, stopping a circulation pump for circulating the water, and then re-supplying water into the drum, the re-supplied water being received in the washing water receiving space.

6. The method of claim 5, further comprising re-circulating the water received in the washing water receiving space by driving the circulation pump when the level of water received in the washing water receiving space reaches an upper limitation level.

7. The method of claim 1, wherein injecting steam into the drum further comprises:

supplying water into a container of the steam generator, the water being stored in the container of the steam generator; and detecting a level of the water stored in the container; and if the detected level of the water reaches a preset upper-limitation level, driving a heater of the steam generator.

8. The method of claim 1, wherein the washing cycle is started right after injecting steam into the drum.

9. The method of claim 1, wherein injecting steam into the drum further comprises:

supplying water into the steam generator; and generating steam by heating the water supplied to the steam generator using a heater.

* * * * *